US010731314B2

(12) United States Patent
Barton

(10) Patent No.: US 10,731,314 B2
(45) Date of Patent: Aug. 4, 2020

(54) SYSTEM FOR SEALING A MANHOLE RISER RING ASSEMBLY

(71) Applicant: Kenneth S. Barton, Lake Hamilton, FL (US)

(72) Inventor: Kenneth S. Barton, Lake Hamilton, FL (US)

( * ) Notice: Subject to any disclaimer, the term of this patent is extended or adjusted under 35 U.S.C. 154(b) by 0 days.

(21) Appl. No.: 16/006,422

(22) Filed: Jun. 12, 2018

(65) Prior Publication Data

US 2018/0355577 A1 Dec. 13, 2018

Related U.S. Application Data

(60) Provisional application No. 62/518,291, filed on Jun. 12, 2017.

(51) Int. Cl.
*E02D 29/14* (2006.01)
*E02D 29/12* (2006.01)

(52) U.S. Cl.
CPC ..... *E02D 29/149* (2013.01); *E02D 29/128* (2013.01); *E02D 29/1409* (2013.01); *E02D 2200/14* (2013.01); *E02D 2300/0025* (2013.01); *E02D 2450/00* (2013.01)

(58) Field of Classification Search
CPC ..... F16J 15/10; E02D 29/14; E02D 29/1409; E02D 29/149; E02D 29/16; E02D 29/128
USPC ..... 404/26
See application file for complete search history.

(56) References Cited

U.S. PATENT DOCUMENTS 2,254,668 A * 9/1941 Tomek ..... E02D 29/14 404/26
3,611,889 A * 10/1971 Levinson ..... E02D 29/1409 404/26
4,305,679 A * 12/1981 Modi ..... E02D 29/14 210/165
4,540,310 A * 9/1985 Ditcher ..... E02D 29/14 277/616
4,582,449 A * 4/1986 Vosswinkel ..... E02D 29/14 264/32
4,666,333 A * 5/1987 Armstrong ..... E02D 29/14 404/25
4,737,220 A * 4/1988 Ditcher ..... E02D 29/14 156/158
4,772,154 A * 9/1988 Caroulle ..... E02D 29/149 404/25
4,927,290 A * 5/1990 Bowman ..... E02D 29/124 404/26
5,209,601 A * 5/1993 Odill ..... E02D 29/14 404/26
5,240,345 A * 8/1993 Gagas ..... E02D 29/14 404/25

(Continued)

*Primary Examiner* — Thomas B Will
*Assistant Examiner* — Katherine J Chu
(74) *Attorney, Agent, or Firm* — William E. Noonan

(57) ABSTRACT

A system and method are disclosed for sealing an annular manhole riser ring assembly. A generally flat, bendable liner includes a flat strip that is generally conformably engageable with an interior circumferential surface of the riser ring assembly. An outer surface of the liner strip carries a plurality of spacer elements that form a void between the generally flat liner strip and the engaged inner circumferential surface of the riser ring assembly. An expandable tensioning device is operated to press the riser ring assembly against the circumferential surface of the riser ring assembly. A flexible bonding substance is introduced into the void and allowed to set to seal the riser ring assembly.

15 Claims, 9 Drawing Sheets

(56) References Cited

U.S. PATENT DOCUMENTS

RE34,550 E * 2/1994 Bowman ..... E02D 29/14 404/26
5,316,407 A * 5/1994 Miller ..... E02D 29/14 404/25
5,431,553 A * 7/1995 Topf, Jr. ..... B29C 33/00 249/10
5,511,897 A * 4/1996 House ..... E02D 29/12 156/71
5,529,312 A * 6/1996 Skinner ..... F16L 5/08 277/604
5,549,334 A * 8/1996 Zeisler ..... F16L 21/00 24/20 TT
5,564,855 A * 10/1996 Anderson ..... E02D 29/1409 404/26
5,634,739 A * 6/1997 Armstrong ..... E02D 29/12 404/26
5,800,648 A * 9/1998 House ..... E02D 29/12 156/71
5,899,024 A * 5/1999 Stannard ..... E02D 29/1409 404/26
5,956,905 A * 9/1999 Wiedrich ..... E02D 29/121 220/220
7,150,580 B1 * 12/2006 Ess ..... E02D 29/12 404/26
7,165,911 B2 * 1/2007 Fier ..... E02D 29/1409 404/25
7,263,746 B2 * 9/2007 Neuhaus ..... F16L 5/02 24/279
7,401,998 B2 * 7/2008 Wilson ..... E02D 29/124 404/26
7,770,333 B2 * 8/2010 Meyers ..... F16L 55/11 220/4.03
7,966,786 B2 * 6/2011 Koteskey ..... E02D 29/12 220/4.04
8,720,907 B2 * 5/2014 Worley ..... F16L 5/10 24/279
2006/0042174 A1 * 3/2006 Meyers ..... E03F 5/22 52/20
2011/0203192 A1 * 8/2011 Schneider ..... B65D 90/105 52/20
2014/0328622 A1 * 11/2014 Wasiuta ..... E02D 29/1409 404/26

* cited by examiner

SYSTEM FOR SEALING A MANHOLE RISER RING ASSEMBLY

RELATED APPLICATION

This application claims the benefit of U.S. Provisional Application Ser. No. 62/518,291 filed on Jun. 12, 2017.

FIELD OF THE INVENTION

This invention relates to a system for effectively installing and sealing manhole riser and cover adjustment rings. The system enables a manhole to be adjusted and brought up to grade while strengthening the riser rings and effectively sealing the manhole against water intrusion and leakage.

BACKGROUND OF THE INVENTION

Manholes are commonly utilized to provide access to underground sewer and utility lines. Over time, the manhole and associated manhole cover are apt to settle below the grade of the roadway or other surface in which the manhole is formed. This can be caused by various factors such as heavy vehicular traffic, precipitation, a high water table and resurfacing of the roadway. Conventionally, various types of manhole riser and cover adjustment rings have been used to bring the manhole up to grade. Typically, one or more of these rings, which are often composed of recycled polyethylene pipe, are mounted above the manhole to bring the cover to grade. If two or more risers are needed, they are bonded together. However, conventional riser rings often feature very narrow contact surfaces, which do not provide for satisfactory bonding. Accordingly, the known risers remain quite susceptible to separation, cracking and deterioration from heavy traffic, precipitation, adverse weather conditions or high water levels. This can again lead to excessive settlement around the manhole cover, which can create potholes and uneven road surfaces that are both unattractive and disruptive to traffic. Moreover, cracked and deteriorating riser rings can cause water to leak into the manhole. Such water intrusion is likely to progressively increase as time passes, which compounds and accelerates deterioration of the riser(s). In severe situations such as heavy rain storms, this can cause flooding of the underground utility station accessed through the manhole.

Rubber gaskets and coatings have been used to limit water infiltration through cracked or aging manholes and manhole risers. However, conventional gaskets usually provide relatively poor adhesion and little if any structural integrity. Such gaskets require solid and continuous riser contact surfaces which, as previously indicated, most conventional risers lack. Coatings tend to crack or peel. Most coatings are relatively brittle and do not adhere well to the standard riser rings that are commonly used.

Alternatively, rubber rings as well as concrete and brick risers have been utilized. All of these materials remain susceptible to cracking and failure particularly under the harsh conditions and environments to which most manholes are subjected.

SUMMARY OF THE INVENTION

It is therefore an object of the present invention to provide a system for more effectively installing and sealing manhole riser and cover adjustment rings so that water intrusion and damaging leaks into a manhole are reduced.

It is a further object of this invention to provide a system for effectively sealing cracked, deteriorated and damaged manhole riser rings so that a manhole cover that has settled can be repaired quickly and reliably.

It is a further object, of this invention to provide a system for sealing a manhole riser ring assembly, which stops water infiltration and adds strength and flexibility to prevent cracking in repaired areas and roadways in which the manhole is formed.

It is a further object of this invention to provide a system for bonding together and sealing stacked manhole riser rings, which restricts manhole leaks and resulting manhole damage far more effectively than conventional gaskets and seals.

It is a further object of this invention to provide a system and method which greatly facilitate and reduce the time and expense previously associated with repairing, sealing and adjusting manhole riser and cover adjustment rings.

It is a further object of this invention to provide a system and method for more effectively and reliably sealing various types of manholes and manhole riser rings against water infiltration and intrusion so that flooding of and damage to the manhole and underground utility station or line are avoided.

This invention features a system for sealing one or more manhole riser or cover adjustment rings. The system includes a bendable liner for generally conformably engaging an interior surface of an annular riser ring assembly, which riser ring assembly includes one or more annular riser rings. When multiple riser rings are employed they are typically stacked or juxtaposed within the manhole proximate an entry to the manhole. A selectively adjustable tensioning device, is engaged with an interior surface of the bendable liner and expanded to press the liner against an interior circumferential surface of the annular riser ring assembly. The bendable liner is secured to the inner circumferential surface of the riser ring assembly by a bonding substance or heat welding to effectively seal the inner circumferential surface of the riser ring assembly.

In a preferred embodiment, the bendable liner includes a generally flat strip that carries a plurality of knobs or spacer elements, which extend outwardly from an outer surface of the strip. This forms a void between the flat strip of the liner and the inner circumferential surface of the riser ring assembly. The liner is typically fastened to the riser ring assembly in such cases by an epoxy material or other flexible bonding substance that is introduced into the void between the liner strip and the riser ring assembly. The liner is pressed against the riser ring assembly by the tensioning device and the introduced bonding substance is allowed to set to secure the liner to the inner circumferential surface of the riser ring assembly. The tensioning device may include a circumferentially adjustable band that is selectively expanded to apply pressure to the liner and retracted to disengage the tensioning band from the liner.

A lower seal may be interengaged between the liner and the riser ring assembly below the void. The lower seal retains the bonding substance introduced into the void so that the bonding substance effectively sets within the void and does not leak therefrom.

In an alternative embodiment, the system may include a polyethylene or other plastic manhole gasket featuring a lower flared flange that has a truncated conical shape and an upper rim that is attached unitarily to and extends upwardly from an upper end of the flange. This version is intended principally for use with a polyethylene or other plastic manhole. The gasket is flexible such that the flange may be inserted into and conformably interengage a tapered upper portion of the manhole. The rim extends upwardly from the flange and is generally conformably interengageable with a flat inner surface of the bendable liner. The flange and the rim are heat welded or otherwise fastened to the interior of the manhole and the bendable liner respectively. This effectively seals gaps between the manhole and any riser or cover adjustment rings stacked above the manhole and prevents bonding substance introduced into the void between the liner and the riser ring assembly from leaking into the manhole prior to setting.

This invention also features a method for employing the system to seal a manhole riser ring assembly. Preliminarily, one ore more riser rings comprising the assembly are cleaned and roughened to provide a better adhesion surface. The area of the manhole adjacent to the riser ring assembly is sealed by an appropriate bonding substance to restrict active water infiltration during as the riser ring assembly itself is seated. A substantially flat, bendable liner strip having spacer elements extending from an outer surface thereof is cut or otherwise formed so that it is conformably interengageable with an inner circumferential surface of the annular riser ring assembly. The liner is manipulated to conformably interengage the riser ring assembly and a tensioning device is engaged with the liner and operated to press the liner against the inner circumferential surface of the riser ring assembly. The spacer elements define a void between the generally flat liner strip and the interior circumferential surface of the riser ring assembly. With the riser ring assembly held in place by the tensioning device against the riser ring assembly, a flexible bonding substance is then introduced into the void between the liner and the riser ring assembly. The bonding substance is introduced until the void and optionally any other communicating voids within the riser ring assembly are filled to a selected degree with the bonding substance. The bonding substance is then allowed the cure or set and the tensioning device is removed.

Preferably, a lower seal is interconnected between the liner and the riser ring assembly beneath the void. This causes the bonding substance to be retained within the void as it cures and sets without leaking from the void. Typically, the liner is initially formed and extended about the inner circumference of the riser ring assembly as an elongate flat strip having two opposing ends. After the tensioning device is disengaged from the liner, the respective ends of the liner may be welded together to form a seam.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
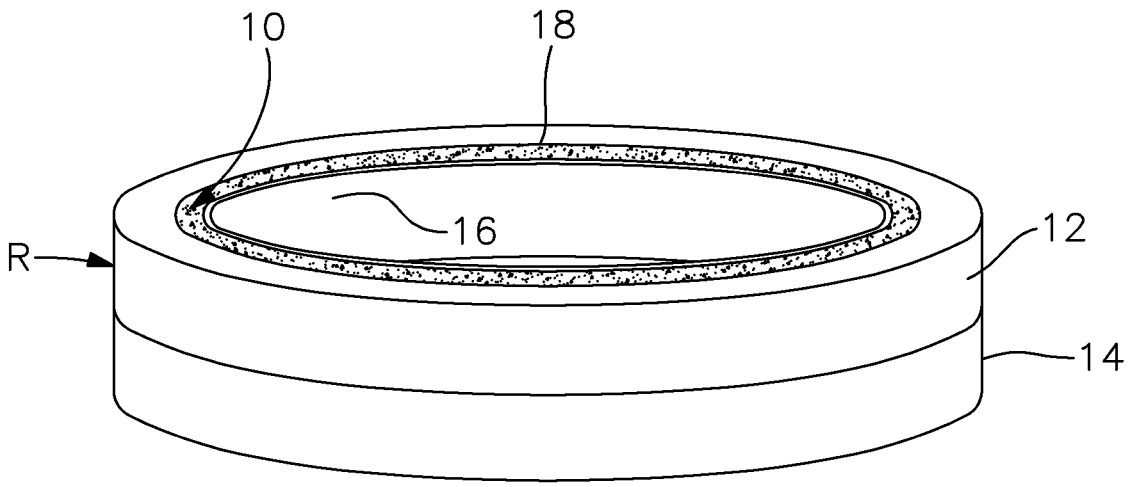
FIG. 1 is a simplified upper perspective view of a preferred system for sealing a manhole riser ring assembly according to this invention wherein a pair of stacked manhole riser rings are sealed.
Figure 2:
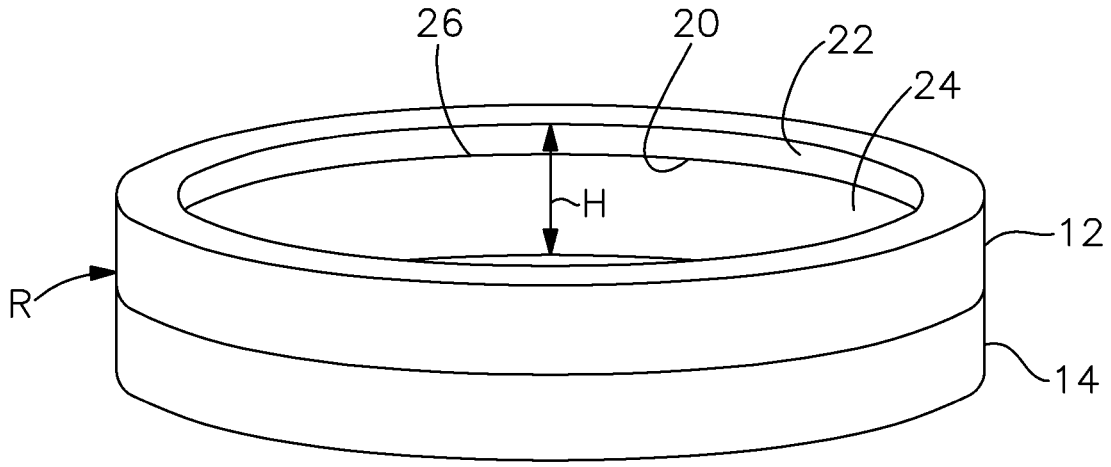
FIG. 2 is a simplified upper perspective view of a pair of stacked manhole riser rings prior to installation of the sealing system.

There is shown in FIG. 1 a system 10 for bonding together and effectively sealing a manhole riser ring assembly R. The riser ring assembly comprises a pair of stacked riser or cover adjustment rings 12 and 14, which may include various known types of manhole riser and cover adjustment rings. Various other numbers of rings (i.e. a single ring or other pluralities of rings) may be included in the assembly within the scope of this invention. As used herein "riser ring assembly" should be construed broadly to encompass all types of structures comprising such rings. The rings may be composed of various types of durable and strong plastic such as polyethylene. Other non-plastic rings, which will be known to persons skilled in the art, may also be sealed using the system and installation techniques disclosed herein. It should be understood that the sealing system disclosed herein may be used for rings having all types of compositions, constructions, surface features and configurations. For simplicity, FIGS. 1 and 2 depict rings 12 and 14 without any surface features such as holes, grooves, pockets, notches, ribs, projections, etc. It should be understood that the actual rings being sealed may include various features of this type as are exhibited on conventional riser rings. Moreover, the system and method of this invention may be employed to effectively bond and seal either a single ring or any plurality of rings, which are typically stacked coaxially upon one another in order to bring a manhole to the grade of the highway or other surface in which the manhole is formed.

As shown in FIG. 1, system 10 includes an elongate liner strip 16, which is bonded to an inner annular surface of stacked rings 12 and 14 by a two-part epoxy or other preferably flexible bonding substance 18. This effectively bonds the stacked rings 12 and 14 together and seals the rings of the riser ring assembly R against leaking and water intrusion. Additional components of system 10 and a process for installing the sealing system in the riser ring assembly is described more fully below.

Prior to the installation of sealing system 10, stacked riser rings 12 and 14 of riser ring assembly R appear as shown in FIG. 2. As previously explained, riser rings deteriorate with age and especially when subjected to high water levels, adverse weather conditions, heavy traffic, etc. In particular, gaps arise between the relatively narrow ribs that support upper ring 12 on top of lower ring 14. This causes damaging leaks into the manhole. These leaks are addressed and effectively sealed by covering and sealing the interior circumferential surface 20 of riser ring assembly R, which comprises the interior circumferential surfaces 22 and 24 of stacked rings 12 and 14, respectively. Most critically, the interface 26 between rings 12 and 14, which is a principal source of water intrusion is covered and sealed by system 10.

Figure 3:
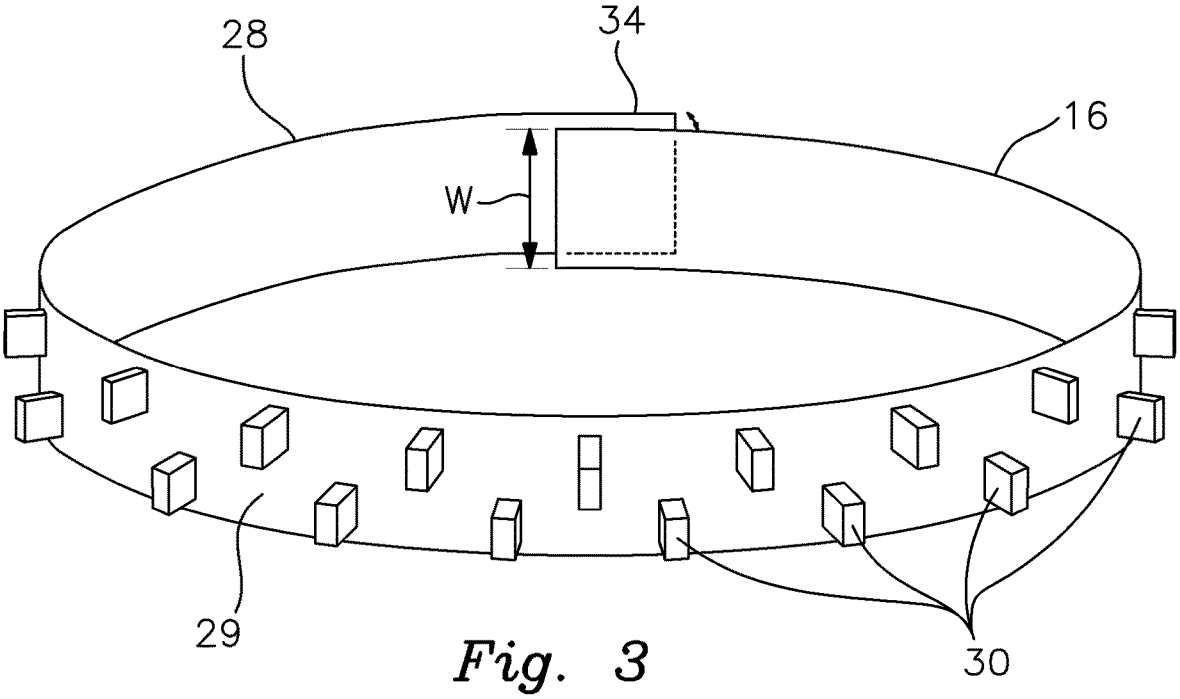
FIG. 3 is a perspective view of a preferred liner used in the sealing system.

FIG. 3 depicts a liner 16 for covering the interior circumferential surfaces 22 and 24 (FIG. 2) of rings 12 and 14 respectively, as well as the interface 26 (FIG. 2) between those rings. The As shown in FIG. 3, the liner includes an elongate, generally flat strip 28 of bendable plastic material such, as polyethylene. The outer surface 29 of strip 28 carries a plurality of studs, knobs or spacer elements 30, which are formed unitarily with and extend or project outwardly from the outer surface of flat strip 28. Liner 16 may comprise an elongate strip of material cut from a larger piece of plastic. Other flexible materials that are effectively bondable to the riser ring assembly may be employed for the liner. To properly size and configure liner 16, the installer first determines the interior circumference or diameter of the riser ring assembly R, as well as the height or thickness of the stacked riser rings. Strip 28 is then cut so that the width W of the strip is sufficient to cover the entire height H of the riser rings. See height H designated in FIG. 2. The length of bendable liner 16 should be approximately 3" longer than the interior circumference of riser ring, assembly R such that an overlap 34 is provided as shown in FIG. 3. The thickness or width W may be selected as required to conform to the width of the manhole ring being sealed. The liner strip can typically be anywhere from 1" to 1' wide although other widths may be employed within the scope of this invention.

The diverging or otherwise projecting spacers 30 formed integrally unitarily on the outer surface of strip 28 typically have a height of about ⅓ to ½". Prior to installing the liner within the riser ring assembly R, the installer preferably cuts each of the spacers 30 to a height of approximately ¼". This reduces the volume of the space or void formed between the liner strip and the riser rings. As a result, introducing the epoxy or other bonding substance into the void, as described below, is facilitated and the amount and cost of the bonding substance required to fill the void is reduced. In any event, the height of the spacer elements may be selected and adjusted so that the particular sealing application involved is most effectively and efficiently completed. Taller spacer elements increase the bonding surface of the liner, which generally improves adhesion between the liner and the inner circumferential surface of the riser ring assembly. On the other hand, this increases the volume of the void, which in turn requires a greater amount of bonding substance and increased expense to fill. The installer may select and, if necessary, adjust the height of the spacer elements to balance these factors and achieve the most effective and cost efficient bond possible.

Figure 4:
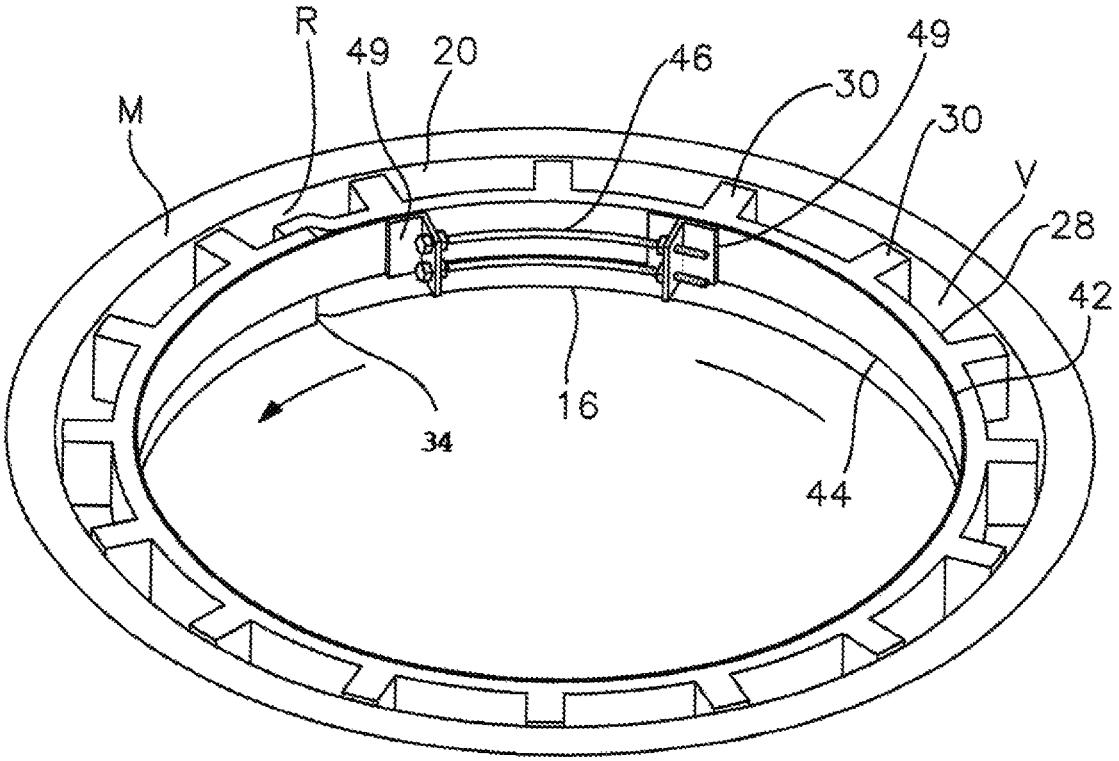
FIG. 4 is an upper perspective view of a manhole opening with the liner deployed to engage the interior circumferential surface of the annular riser ring assembly and with an expandable band operatively engaging an inner surface of the liner and being expanded to press the liner against the interior circumferential surface of the riser ring assembly.

After liner 16 is cut to generally conform to the circumference and width of the surface being sealed, it is installed within a manhole M in the manner shown in FIG. 4 such that liner 16 engages the interior circumferential surface 20 (see also FIG. 2) of riser ring assembly R. Spacers 30 are carried on the outer surface of the liner and those spacers face the inner circumferential surface 20 of riser R. The liner is wrapped within the riser ring assembly such that the respective ends of the liner overlap at 34.

Figure 6:
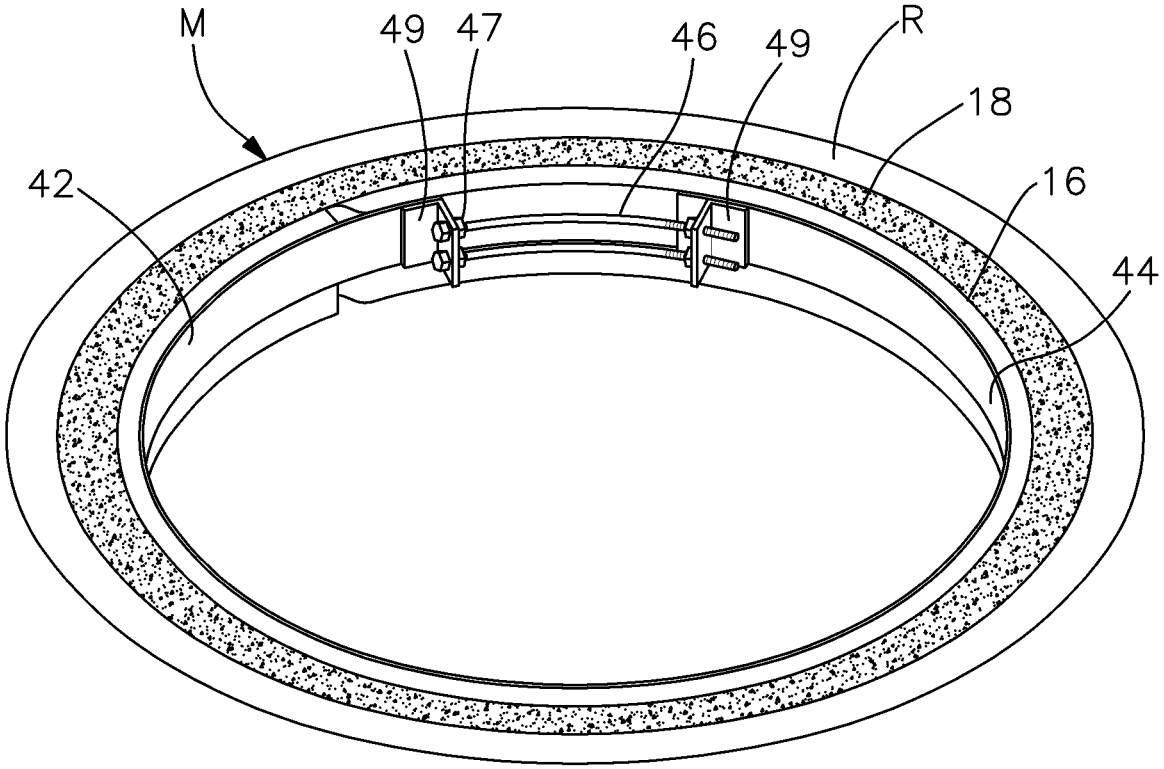
FIG. 6 is an upper perspective view of the sealing system after the bonding substance has been introduced and before the tensioning band has been removed.
Figure 7:
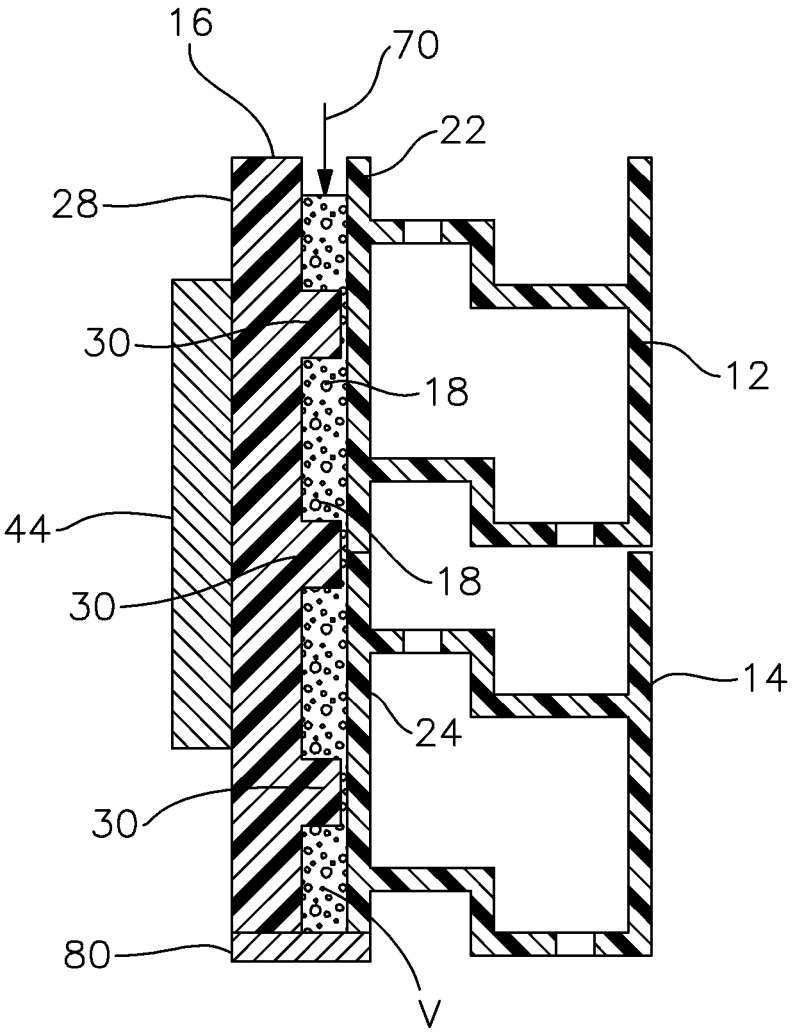
FIG. 7 is an elevational, cross sectional view of the sealing system, which specifically shows the introduction of bonding substance into the void between the liner and the riser ring assembly.

Liner 16 is held in interengagement with the interior circumferential surface 20 of riser ring assembly R by an adjustable tensioning device 42. The tensioning device comprises a circumferentially and diametrically expandable annular band 44 (see also FIGS. 5 and 6) which is composed of a strip of resilient metal or metal alloy that overlaps itself to form a ring. The band is selectively expanded and contracted by means of a pair of adjustment screws 46. Each screw extends between and adjustably interconnects a pair of L-brackets 49, which are, in turn, respectively attached to opposite ends of band 44. Each screw 46 also threadably engages a respective pair of tightening nuts 47, each nut being installed interiorly adjacent a respective L-bracket. This allows adjustment screws 46 to be selectively tightened, which circumferentially and diametrically contracts band 44 and loosened, which circumferentially and diametrically expands band 44. Initially, the band is installed inside of liner 16 and the screws are loosened to expand the band so that, it expands and presses against the inner surface of liner 16. This, in turn, presses the liner against the surrounding interior circumferential surface of riser ring assembly R. As a result, band 44 effectively holds the liner in tensioned interengagement with the interior annular surface of the riser rings. A space or void V, best shown in FIGS. 4 and 7, is thereby formed between flat strip 28 of liner 16 and the inner circumferential surface 20 of riser ring assembly R.

Figure 5:
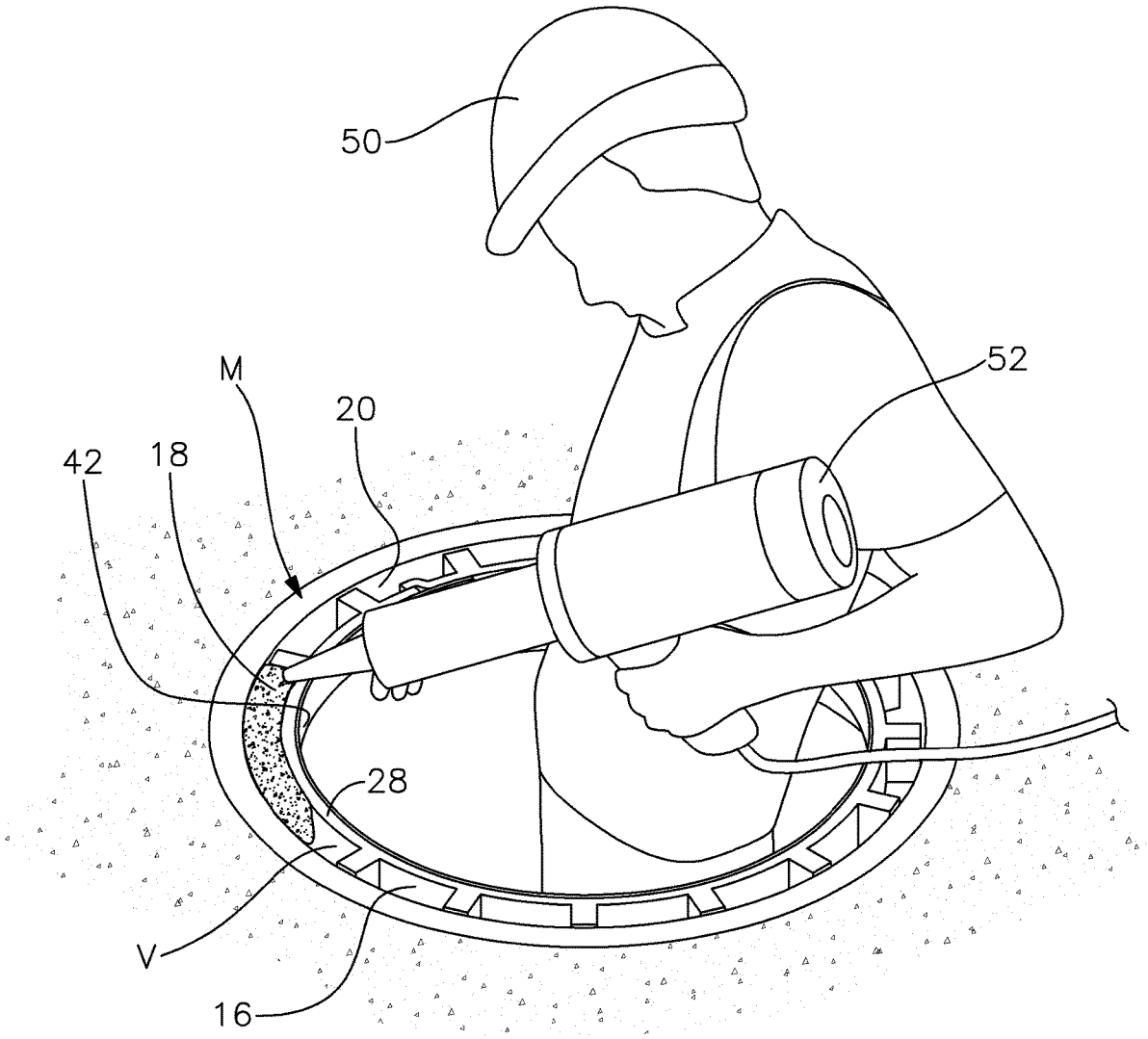
FIG. 5 is a perspective view of a worker introducing a bonding substance into the void between the liner and the annular riser ring assembly.

As shown in FIG. 5, worker 50 utilizes an injector device 52 to introduce a two-part epoxy or other flexible bonding substance 18 into the void V formed between liner strip 28 and interior circumferential surface 20. See also FIG. 6 wherein bonding substance 18 fills the gap or void between liner 16 and riser ring assembly R. As further shown in FIG. 7, bonding substance 18 is introduced, as indicated by arrow 70, into void V such that the bonding substance migrates through and fills the void. Substance 18 thereby effectively interengages and bonds liner 16, including planar strip 28 and spacers 30, to interior circumferential walls 22 and 24 of rings 12 and 14, respectively. Spacers 30 are also especially effective for gripping and adhering to concrete manhole and manhole riser structures. A lower bonding substance retention seal 80, which may comprise various types of material, is interengaged between the lower ends of liner 16, and the interior circumferential surface 24 of lowermost ring 14. Seal 80 retains the epoxy or other bonding substance 18 within void V and prevents that bonding substance from leaking out of the bottom of the void while the bonding substance sets. This lower seal can be effected by welding, hydraulic cement or backer rod material, which is adhesively secured to the bottom of the liner and annular ring.

A two-part epoxy may be injected using Stephen's Technologies 101 Flex Epoxy caulking tubes. Alternatively, chemical pumps, masonry bags and other conventional equipment for injecting bonding materials may be utilized. A static mixer is utilized when caulking tubes or a two-part pump system are employed. Preferably, worker 50 injects bonding substance 18 gradually proceeding around the top of the circular void V until the void is filled.

Figure 8:
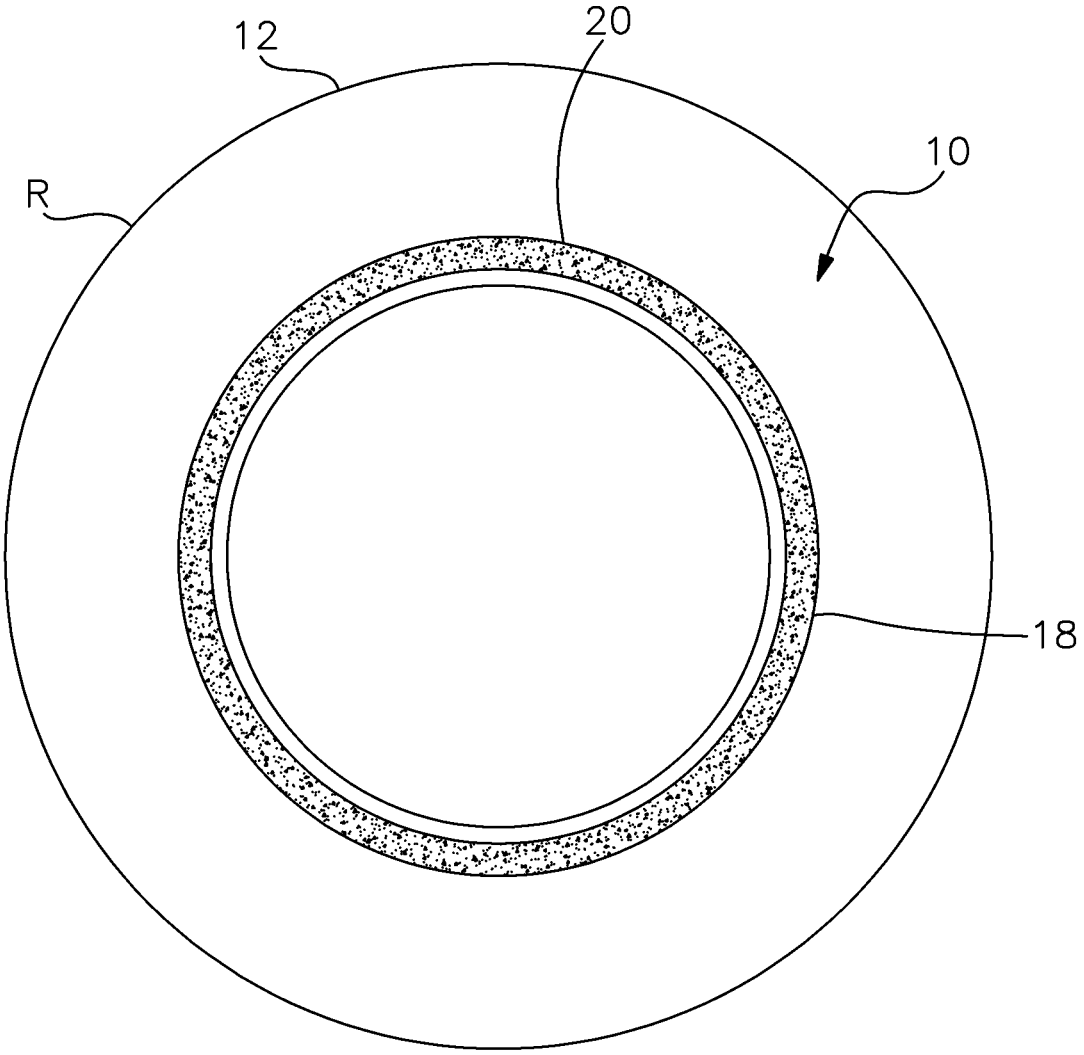
FIG. 8 is a top plan view of the sealing system as installed in the riser ring assembly.

FIG. 8 depicts sealing system 10 as fully installed within riser ring assembly R. After the bonding substance 18 is introduced into the void between the liner and the riser ring assembly, the bonding substance is allowed to set or cure for approximately 2 hours. The expandable tensioning band 44 is then contracted by tightening adjustment screws 46 and the band is removed. The sealing system is installed and an improved leak resistant seal is thereby achieved. In particular, liner 16 and attached spacers 30 are effectively bonded by the bonding substance 18 to the interior circumferential surface 20 of riser ring assembly R. Water infiltration through the riser ring assembly R is largely, if not entirely abated.

System 10 is typically installed in the following manner. Initially, riser rings 12 and 14 are cleaned of debris and oil. Any obvious surrounding voids and cracks in the manhole are filled and deteriorated cement or bricks are replaced. Rings 12 and 14 are then roughened, typically using a hard mechanical wire brush. Active infiltration is sealed using conventional sealing materials in order to stop active leaks while the seal of this invention is being installed.

After the manhole and surrounding area are properly prepared, the bendable liner is measured and cut to the proper height and diameter of the annular surface to be sealed. The size of the liner material spacers are selected to provide the best adhesion and bonding for the structure or damage being repaired. The liner is manipulated and held in place with a tensioning device as previously described. In alternative embodiments, other devices for holding the liner forcefully against the interior circumferential surface of the riser ring assembly may be utilized.

Lower seal 80 is installed to close the bottom of void V. As previously described, various materials and methods of sealing the bottom of the void may be utilized. Flexible bonding substance is then filled into the void between the liner and the riser ring assembly. The epoxy or other bonding substance is preferably injected or otherwise introduced until the void is completely filled. The bonding substance is then allowed to cure and harden. After that substance sets sufficiently, the tensioning band is removed. The seam formed at overlapping ends 34 of the liner may be heat sealed or welded so that the assembled and fully installed seal riser system is achieved as shown in FIGS. 1 and 8.

Figure 9:
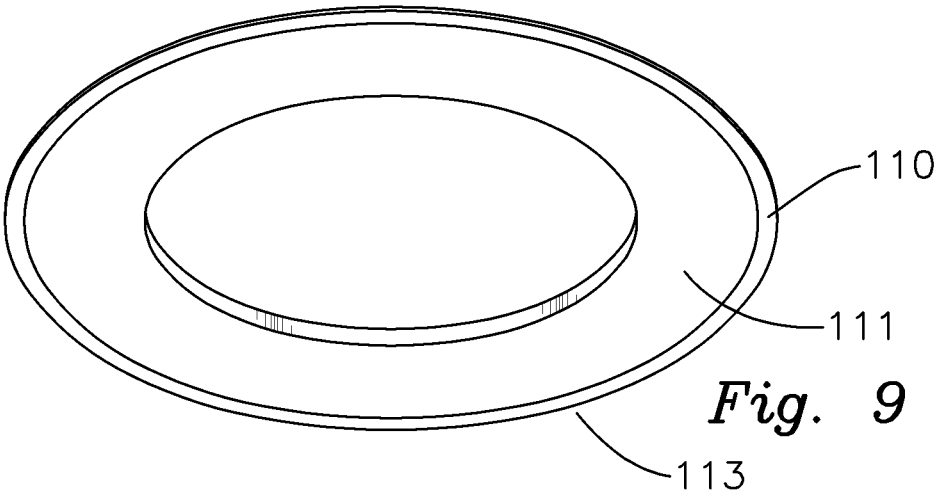
FIG. 9 is a bottom perspective view of an optional manhole gasket that may be employed in the sealing system and which is particularly effective for use with a plastic manhole station.
Figure 10:
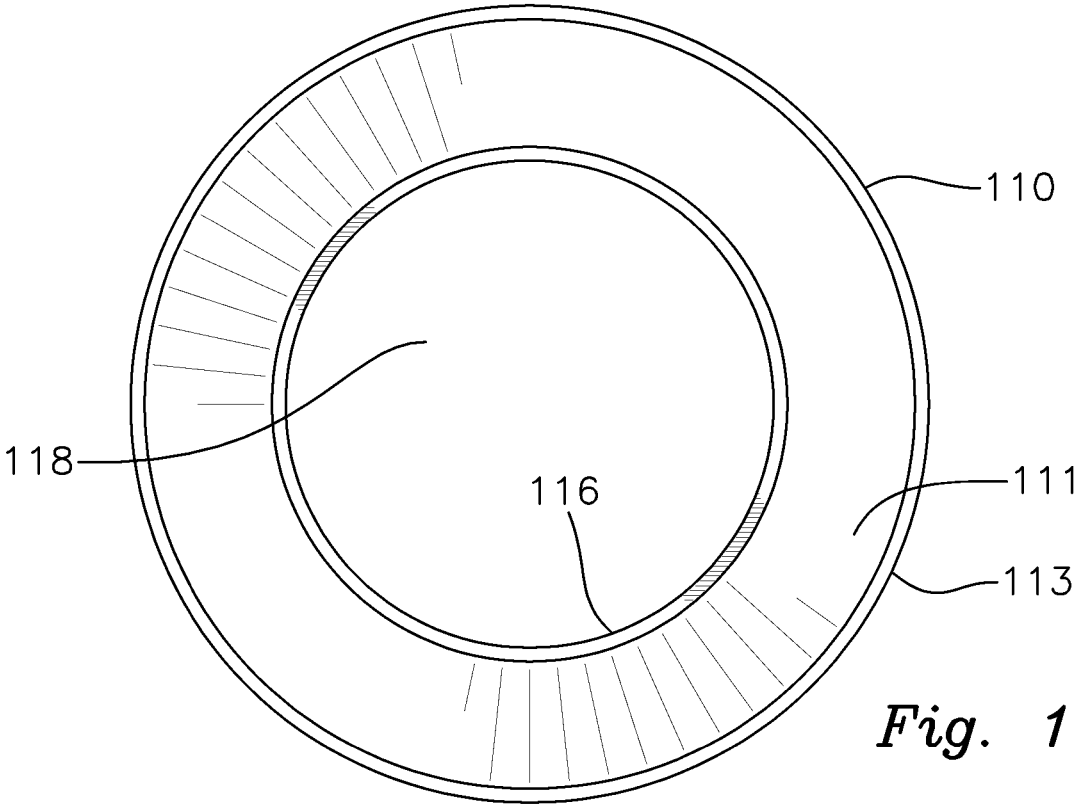
FIG. 10 is a top plan view of the manhole gasket.
Figure 11:
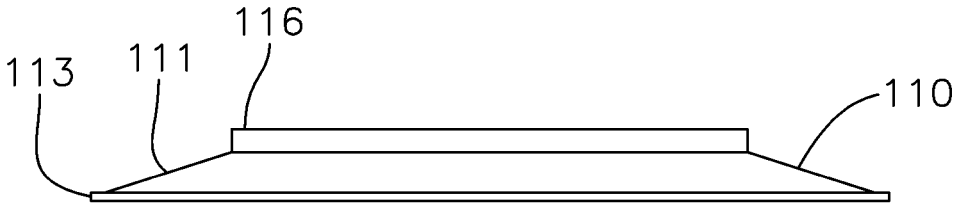
FIG. 11 is an elevational side view of the manhole gasket.

The manhole gasket 110 shown in FIGS. 9-11 may be used in conjunction with system 10 for effectively sealing the bottom of the void in embodiments featuring risers used with polyethylene, plastic or concrete manholes and manhole stations. Gasket 10 preferably comprises a one-piece, low density and flexible polyethylene construction although other comparable materials may be utilized. The gasket features a lower flared flange portion 111 having a truncated conical shape and surrounded by an optional peripheral lip 113. A unitary annular rim 116 extends upwardly from lower portion 111 such that a central opening is formed through wall 116 and lower portion 111.

Figure 12:
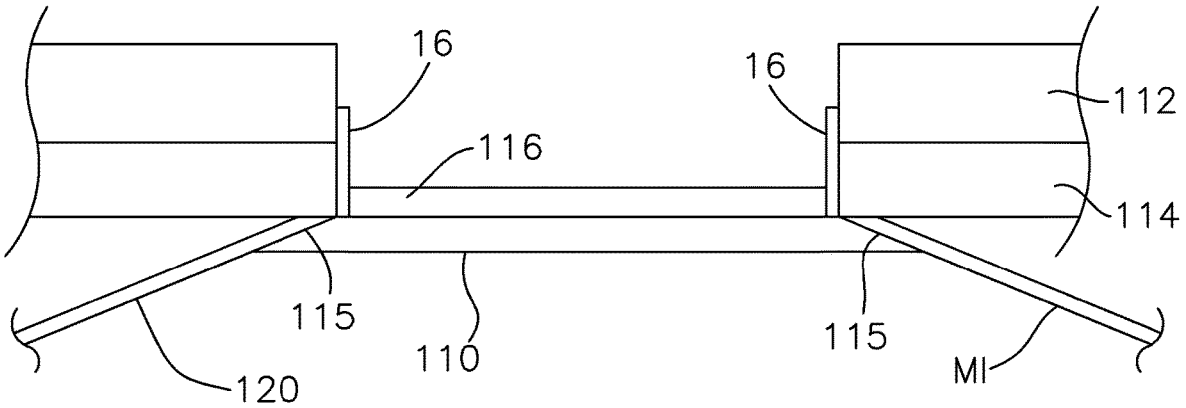
FIG. 12 is a cross sectional view of the manhole gasket and interengaged liner installed in a plastic manhole station for sealing the manhole station and a pair of riser rings mounted thereon.

Gasket 110 is installed in a polyethylene (PE) manhole M1 as shown in FIG. 12. In particular, manhole M1 has been provided with a pair of stacked riser rings 112 and 114. A liner 16, as previously described, is bonded to the interior circumferential surfaces of stacked rings 112 and 114. This is achieved in the manner previously described.

Gasket 110 is installed in manhole M1 such that lower truncated conical portion 111 engages the inwardly tapered walls 120 of manhole M1. The gasket is bendable to allow the lower portion to conform to the shape of the manhole. This lower portion may be welded to the plastic manhole such as at interengaging surfaces 115 or secured thereto by other means including concrete lug nuts when the manhole comprises a concrete construction.

Upper rim 116 is interengaged with and welded to an inside surface of liner 16. Gasket 110 thereby provides for significantly improved sealing of plastic or concrete manhole M1 and restricts epoxy or other bonding substance from leaking out of the void previously described between liner 16 and the riser ring assembly before the bonding substance is able to set. As a result, a secure and sealing bond is achieved between the liner and the riser ring assembly.

The sealing system of this invention significantly reduces water infiltration into aged, damaged and/or deteriorating manholes. The system may also be used effectively to seal and strengthen new manholes which have not yet deteriorated or settled. The use of a flexible bonding substance is especially preferred because it better resists the damaging forces produced by heavy vehicular traffic. Flexible bonding material is also more resistant to cracking. The repairs and sealing are performed relatively quickly and economically. The system significantly prolongs the effective life of most manhole riser assemblies while reducing the frequency and expense of riser repairs.

From the foregoing it may be seen that the apparatus of this invention provides for a system and method for sealing underground manholes, and more particularly manhole riser and cover adjustment rings. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A system for sealing a generally annular riser ring assembly, which riser ring assembly is for installation within a manhole proximate an entry to the manhole, the riser ring assembly having an interior circumferential surface surrounding an opening into the manhole, said system comprising:

a bendable liner including an elongate, generally annular and circumferentially adjustable liner strip having distinct opposite ends and a length that is greater than the interior circumferential surface of the riser ring assembly, said liner strip having a substantially flat exterior surface for facing the interior circumferential surface of the annular riser ring, said exterior surface carrying a plurality of spacer elements formed unitarily with said liner strip and projecting outwardly from said exterior surface of said strip;

a tensioning device including a substantially flat, circumferentially adjustable and generally annular band that is interengaged with a substantially flat interior surface of said liner strip, said band being selectively expanded circumferentially to press said bendable liner generally conformably against the interior circumferential surface of the riser ring assembly such that said spacer elements form a void between said liner strip and the inner circumferential surface of the riser ring assembly; and a bonding substance received, within said, void to, bond said bendable liner to the interior circumferential surface of the riser ring assembly;

said adjustable band being circumferentially contracted to disengage said adjustable band from said interior surface of said liner strip and permit said adjustable tensioning device to be removed from the riser ring assembly while said bendable liner remains bonded and secured to the riser ring assembly.

2. The system of claim 1 in which said adjustable tensioning device includes an adjustment screw mechanism operably interconnected to said adjustable band, said adjustment screw mechanism being operated to selectively expand and contract said band circumferentially.

3. The system of, claim 2 in which said opposite ends of said liner strip overlap each other.

4. The system of claim 2 in which said adjustment screw mechanism is selectively loosened to expand said band and tightened to contract said band.

5. The system of claim 1 in which said substantially flat interior surface of said liner strip is substantially coplanar between upper and lower longitudinal edges of said liner strip for the entire length of the strip.

6. The system of claim 5 in which said liner strip includes a substantially uniform circumference between said top and bottom edges of said strip.

7. The system of claim 1 in which said liner strip has a width sufficient to cover the entire height of the riser ring assembly.

8. The system of claim 1 in which said bonding substance comprises a flexible bonding substance.

9. The system of claim 1 in which said bonding substance is an epoxy material.

10. The system of claim 1 in which a lower seal is supported by said liner below said void to retain said bonding substance introduced into said void so that said bonding substance effectively sets within said void without leaking therefrom.

11. A method for sealing a manhole riser ring assembly, which manhole riser ring assembly includes a generally annular shape and an interior circumferential surface surrounding a central opening, said method comprising:

providing a bendable liner that includes an elongate and generally annular liner strip that is circumferentially adjustable and has distinct opposite overlapping ends, said liner strip being longer than the interior circumference of the annular riser ring assembly;

providing said liner strip with substantially flat interior and exterior surfaces and a plurality of spacer elements unitarily attached to and projecting outwardly from the exterior surface of said strip;

introducing said bendable liner into the central opening of the annular riser ring assembly such that the exterior surface of the bendable liner strip and the spacer elements face the interior circumferential surface of the annular riser ring assembly;

manipulating the bendable liner strip such that the spacers interengage the inner circumferential surface of the riser ring assembly and the bendable liner generally conforms to the circumferential shape of the riser ring assembly;

flushly engaging a substantially flat outer surface of an adjustable annular tensioning band with the interior surface of the bendable liner strip and expanding the circumference of the band to press the liner against the interior circumferential surface of the riser ring assembly such that the spacer elements define a void between the generally flat exterior surface of the liner strip and the interior circumferential surface of the riser ring assembly;

introducing a bonding substance into the void between said bendable liner and the riser ring assembly;

allowing the bonding substance to set and bond the bendable liner to the riser ring assembly;

contracting the band circumferentially to disengage the band from the interior surface of the liner; and removing the tensioning band from the central opening of the riser ring assembly while leaving the bendable liner bonded and secured to the riser ring assembly.

12. The method of claim 11 further including the steps of providing an adjustment screw mechanism operably connected to said tensioning band for selectively expanding and contracting the circumference of the tensioning band.

13. The method of claim 11 including the step of installing a lower seal between the bendable liner and the riser ring assembly and below the void under the bendable liner and the riser ring assembly such that bonding the substance is retained and sets within the void.

14. The method of claim 11 further including the step of welding opposite ends of the liner strip together after the band is disengaged from the bendable liner.

15. A method for sealing the interface between a pair of stacked manhole riser rings having respective interior circumferential surfaces surrounding a central providing an elongate and generally annular bendable plastic liner strip that is longer than the interior circumference of the stacked riser rings and circumferentially adjustable;

providing said liner strip with substantially flat interior and exterior surfaces, which interior surface is substantially coplanar and has a uniform circumference between top and bottom edges of said liner strip for the entire length of the liner strip, and further providing a plurality of spacer elements unitarily attached to and projecting outwardly from the exterior surface of said strip;

introducing said bendable liner into the central opening of the annular riser ring assembly such that the outer surface of the bendable liner strip and the spacer elements face the interior circumferential surface of the stacked riser rings;

manipulating the bendable liner strip such that the spacer elements interengage the inner circumferential surface of the stacked riser rings, the bendable liner generally conforms to the circumferential shape of the stacked riser rings and the interface of the stacked riser rings is covered by the liner;

flushly engaging a substantially flat outer surface of an adjustable, generally annular tensioning band with the flat interior surface of the bendable liner strip and loosening an adjustment screw mechanism operably connected to the tensioning band to circumferentially expand the band and press the liner against the interior circumferential surface of the riser ring assembly such that the spacer elements define a void between the generally flat liner strip and the interior circumferential surface of the stacked riser rings;

introducing a bonding substance into the void between said bendable liner and the riser ring assembly;

allowing the bonding substance to set and bond the bendable liner to the stacked riser rings;

tightening the adjustment screw mechanism to contract the tensioning band circumferentially and disengage the band from the interior surface of the liner; and removing the tensioning band from the central opening of the stacked riser rings while leaving the liner bonded and secured to the riser rings, whereby the interface of the stacked riser rings is sealed by the liner secured to the riser rings.

* * * * *